US007234595B2

(12) United States Patent
Weder

(10) Patent No.: US 7,234,595 B2
(45) **Date of Patent: *Jun. 26, 2007**

(54) HEAT SHRINKABLE COVER FOR DECORATING A FLOWER POT

(75) Inventor: Donald E. Weder, Highland, IL (US)

(73) Assignee: Wanda M. Weder and William F. Straeter, Highland, IL (US), not individually but solely as Trustees of The Family Trust U/T/A dated December 8, 1995.

( * ) Notice: Subject to any disclaimer, the term of this patent is extended or adjusted under 35 U.S.C. 154(b) by 43 days.

This patent is subject to a terminal disclaimer.

(21) Appl. No.: 10/794,145

(22) Filed: Mar. 5, 2004

(65) Prior Publication Data

US 2004/0168942 A1 Sep. 2, 2004

Related U.S. Application Data

(63) Continuation of application No. 10/140,124, filed on May 7, 2002, now abandoned, which is a continuation-in-part of application No. 10/644,240, filed on Aug. 20, 2003, now Pat. No. 6,782,658, which is a continuation of application No. 10/360,945, filed on Feb. 6, 2003, now Pat. No. 6,637,154, which is a continuation of application No. 10/212,826, filed on Aug. 5, 2002, now Pat. No. 6,539,668, which is a continuation of application No. 10/014,779, filed on Oct. 26, 2001, now Pat. No. 6,484,443, which is a continuation of application No. 09/687,025, filed on Oct. 13, 2000, now Pat. No. 6,347,481, which is a continuation of application No. 09/366,440, filed on Aug. 3, 1999, now Pat. No. 6,141,906, which is a continuation of application No. 08/851,058, filed on May 5, 1997, now Pat. No. 5,941,020, which is a continuation of application No. 08/237,078, filed on May 3, 1994, now Pat. No. 5,625,979.

(51) Int. Cl.

| | |
|---|---|
| ***B65D 85/52*** | (2006.01) |
| ***B21D 21/00*** | (2006.01) |
| ***A01G 9/02*** | (2006.01) |
| ***B65B 11/02*** | (2006.01) |

(52) U.S. Cl. ..... 206/423; 29/469.5; 47/72; 53/397; 53/410; 53/464; 229/87.19

(58) Field of Classification Search ..... 206/423, 206/497; 47/72; 53/397, 399, 412, 452, 53/456, 410, 464; 29/469.5
See application file for complete search history.

(56) References Cited

U.S. PATENT DOCUMENTS 3,110,554 A * 11/1963 Yazumi ..... 53/399
3,156,812 A 11/1964 Forman et al.

(Continued)

*Primary Examiner*—Bryon Gehman
(74) *Attorney, Agent, or Firm*—Dunlap, Codding & Rogers, P.C.

(57) ABSTRACT

The present invention relates to apparatuses and methods for providing decorative covers, decorative collars and decorative cover collar combinations for covering a flower pot. The methods and apparatuses are formed from a variety of configurations of heat shrinkable sheet of material placed over all or a portion of a peripheral surface of the flower pot and then heated to shrink the sheet of material into a pressing engagement against the outer peripheral surface of the flower pot.

4 Claims, 4 Drawing Sheets

U.S. PATENT DOCUMENTS 4,377,234 A * 3/1983 Kaplan ..... 206/497
4,795,601 A * 1/1989 Cheng ..... 47/72
4,941,572 A 7/1990 Harris
5,526,932 A * 6/1996 Weder ..... 206/423
5,542,169 A * 8/1996 Weder ..... 29/469.5
5,566,439 A * 10/1996 Weder ..... 29/469.5
5,581,938 A * 12/1996 Weder ..... 47/72
5,592,776 A * 1/1997 Weder ..... 47/72
5,595,022 A * 1/1997 Weder ..... 47/72
5,615,774 A * 4/1997 Weder ..... 206/423
5,625,936 A * 5/1997 Weder ..... 29/469.5
5,625,937 A * 5/1997 Weder ..... 29/469.5
5,625,979 A * 5/1997 Weder ..... 47/72
5,632,077 A * 5/1997 Weder ..... 29/469.5
5,634,558 A * 6/1997 Weder ..... 206/423
5,640,805 A * 6/1997 Weder ..... 47/72
5,682,725 A * 11/1997 Weder ..... 53/412
5,687,845 A * 11/1997 Weder ..... 206/423
5,704,108 A * 1/1998 Weder ..... 29/469.5
5,704,109 A * 1/1998 Weder ..... 29/469.5
5,735,103 A 4/1998 Weder
5,752,649 A 5/1998 Weder
5,809,629 A * 9/1998 Weder ..... 29/469.5
5,810,169 A * 9/1998 Weder ..... 206/423
5,815,905 A * 10/1998 Weder ..... 29/469.5
5,842,569 A * 12/1998 Weder ..... 206/423
5,878,477 A * 3/1999 Weder ..... 29/469.5
5,878,945 A 3/1999 Weder
5,927,048 A * 7/1999 Weder ..... 206/423
5,930,982 A * 8/1999 Weder ..... 206/423
5,944,187 A * 8/1999 Weder ..... 206/423
5,974,651 A * 11/1999 Weder ..... 29/469.5
5,987,849 A 11/1999 Weder
5,991,999 A * 11/1999 Weder ..... 29/469.5
6,021,558 A * 2/2000 Weder ..... 29/469.5
6,047,524 A 4/2000 Weder
6,076,672 A * 6/2000 Weder ..... 206/423
6,115,994 A * 9/2000 Weder ..... 53/397
6,119,860 A * 9/2000 Weder ..... 206/423
6,131,264 A * 10/2000 Weder ..... 29/469.5
6,135,284 A * 10/2000 Weder ..... 206/423
6,145,274 A 11/2000 Weder
6,152,301 A * 11/2000 Weder ..... 206/423
6,182,348 B1 * 2/2001 Weder ..... 29/469.5
6,223,412 B1 * 5/2001 Weder ..... 29/469.5
6,266,920 B1 7/2001 Weder
6,321,435 B1 * 11/2001 Weder ..... 29/469.5
6,321,436 B1 * 11/2001 Weder ..... 29/469.5
6,343,456 B2 2/2002 Weder
6,430,870 B1 8/2002 Weder
6,457,225 B1 * 10/2002 Weder ..... 29/469.5
6,460,241 B2 * 10/2002 Weder ..... 29/469.5
6,463,718 B2 10/2002 Weder
6,481,087 B2 * 11/2002 Weder ..... 29/469.5
6,499,250 B2 12/2002 Weder
6,513,225 B2 * 2/2003 Weder ..... 29/505
6,571,510 B2 6/2003 Weder
6,938,320 B2 * 9/2005 Weder ..... 47/72
2002/0062595 A1 5/2002 Weder
2002/0092267 A1 7/2002 Weder
2002/0121050 A1 9/2002 Weder
2003/0029137 A1 2/2003 Weder
2003/0070358 A1 4/2003 Weder
2003/0097743 A1 5/2003 Weder
2003/0192245 A1 10/2003 Weder
2003/0217510 A1 11/2003 Weder

* cited by examiner

HEAT SHRINKABLE COVER FOR DECORATING A FLOWER POT

CROSS REFERENCE TO RELATED APPLICATIONS

This application is a continuation of U.S. Ser. No. 10/140,124, filed May 7, 2002 now abandoned. This application is also a continuation-in-part of U.S. Ser. No. 10/644,240, filed Aug. 20, 2003 now U.S. Pat. No. 6,782,658; which is a continuation of U.S. Ser. No. 10/360,945, filed Feb. 6, 2003, now U.S. Pat. No. 6,637,154, issued Oct. 28, 2003; which is a continuation of U.S. Ser. No. 10/212,826, filed Aug. 5, 2002, now U.S. Pat. No. 6,539,668, issued Apr. 1, 2003; which is a continuation of U.S. Ser. No. 10/014,779, filed Oct. 26, 2001, now U.S. Pat. No. 6,484,443, issued Nov. 26, 2002; which is a continuation of U.S. Ser. No. 09/687,025, filed Oct. 13, 2000, now U.S. Pat. No. 6,347,481, issued Feb. 19, 2002; which is a continuation of U.S. Ser. No. 09/366,440, filed Aug. 3, 1999, now U.S. Pat. No. 6,141,906, issued Nov. 7, 2000; which is a continuation of U.S. Ser. No. 08/851,058, filed May 5, 1997, now U.S. Pat. No. 5,941,020, issued Aug. 24, 1999; which is a continuation of U.S. Ser. No. 08/237,078, filed May 3, 1994, now U.S. Pat. No. 5,625,979, issued May 6, 1997.

BACKGROUND OF THE INVENTION

The present invention relates to decorative covers for flower pots, and more particularly but not by way of limitation, to decorative covers and/or collars for flower pots formed from heat shrinkable materials.

SUMMARY OF THE INVENTION

The present invention relates to a method for providing a decorative cover for a flower pot. The method is accomplished by providing a flower pot having an open upper end, a substantially closed lower end and an outer peripheral surface, and providing a sheet of heat shrinkable material, sized and dimensioned to be disposed about at least a portion of the outer peripheral surface of the flower pot. The sheet of heat shrinkable material is disposed about at least a portion of the outer peripheral surface of the flower pot and heated to shrink the sheet of heat shrinkable material until the sheet of heat shrinkable material pressingly engages against at least a portion of the outer peripheral surface of the flower pot and is secured to the flower pot thereby providing the decorative cover for the flower pot.

The present invention also relates to a method for providing a decorative collar for a flower pot. This method is accomplished by providing a flower pot having an open upper end, a substantially closed lower end, an outer peripheral surface and a sheet of heat shrinkable material having an opening formed through a central portion thereof, the opening being sized and shaped so as to approximate the shape and perimeter (or the outer peripheral surface) of the flower pot near the open upper end of the flower pot. The closed lower end of the flower is disposed through the opening in the sheet of heat shrinkable material and the sheet of heat shrinkable material is positioned near the open upper end of the flower pot and heated until a portion of the sheet of heat shrinkable material shrinks and pressingly engages against at least a portion of the outer peripheral surface of the flower pot and is secured to the flower pot thereby providing the decorative collar for the flower pot.

The present invention also relates to a floral assembly. The floral assembly includes a flower pot, a floral grouping, a decorative collar and a decorative cover. The flower pot has an open upper end, a substantially closed lower end, an outer peripheral surface and a retaining space for receiving the floral grouping. The floral grouping is disposed within the retaining space of the flower pot. The decorative collar is formed from a first sheet of heat shrinkable material having an opening formed therethrough. The closed lower end of the flower pot is disposed through the opening in the first sheet of heat shrinkable material. The first sheet of heat shrinkable material is then heated to provide the decorative collar for the flower pot. The decorative cover is provided by providing a second sheet of heat shrinkable material dimensioned to be disposed about at least a portion of the outer peripheral surface of a flower pot. The second sheet of heat shrinkable material is disposed about at least a portion of the outer peripheral surface of the flower pot and heated until the second sheet of heat shrinkable material pressingly engages against at least a portion of the outer peripheral surface of the flower pot thereby securing the second sheet of heat shrinkable material to the flower pot.

The present invention also relates to another method for providing a decorative cover for a flower pot. This method is accomplished by providing a flower pot having an open upper end, a substantially closed lower end and an outer peripheral surface. A sleeve formed of a heat shrinkable material is also provided which is sized and dimensioned to be disposed about at least a portion of the outer peripheral surface of the flower pot. The sleeve is then disposed about at least a portion of the outer peripheral surface of the flower pot and heated to shrink the sleeve until the sleeve pressingly engages against at least a portion of the outer peripheral surface of the flower pot to provide the decorative cover for the flower pot.

DETAILED DESCRIPTION OF DRAWINGS

Figure 1:
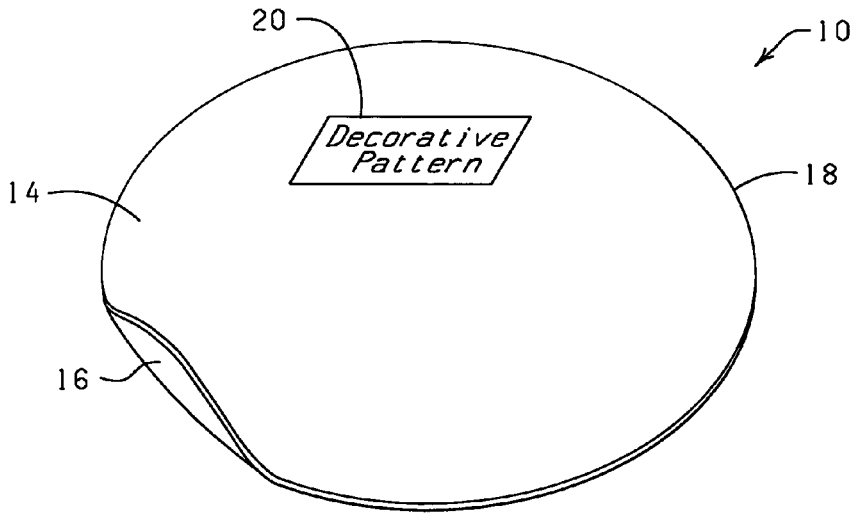
FIG. 1 is a perspective view of a sheet of heat shrinkable material utilized in forming a decorative cover about a flower pot in accordance with the present invention, one edge of the sheet of heat shrinkable material being upwardly turned.
Figure 2:
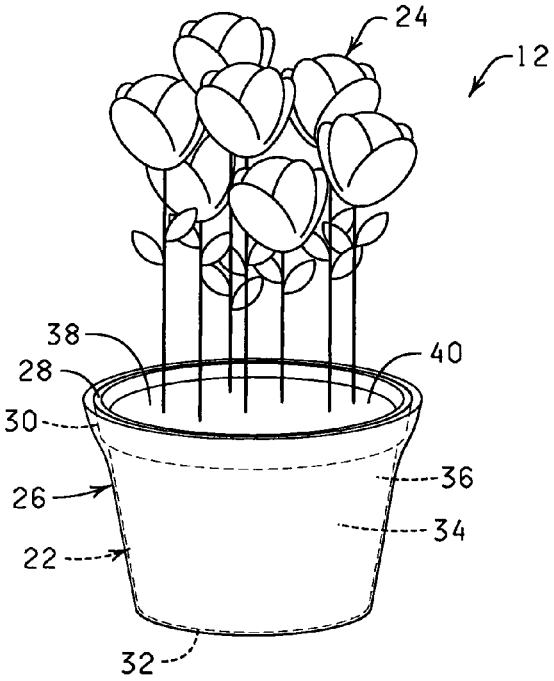
FIG. 2 is a perspective view of a floral assembly constructed in accordance with the present invention.
Figure 3:
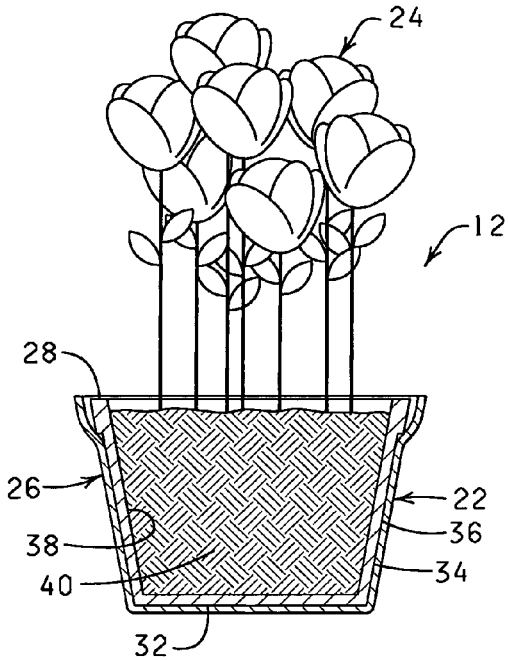
FIG. 3 is a cross-sectional view of the floral assembly of FIG. 2.

Referring now to the drawings, and more particularly to FIG. 1, shown therein and represented by the numeral 10 is a sheet of heat shrinkable material which is utilized in the construction of a floral assembly 12 shown in FIGS. 2 and 3. The sheet of heat shrinkable material 10 has an upper surface 14, a lower surface 16 and a peripheral edge 18.

The term "heat shrinkable material" as used herein means any material which, upon application of a required amount of heat, is reduced in size, i.e. shrunk, so as to conform to an object about which the material is wrapped. Generally such materials are polymeric materials produced by stretching a polymeric film under elevated temperatures and then quenching the stretched polymeric film. Thus, when an elevated temperature above a certain threshold is again applied to the polymeric film, the polymeric film will shrink along the direction that it had been previously stretched.

Heat shrinkable polymeric materials which can be employed in the formation of the decorative covers and collars described hereinafter can be produced from a number of commercially available polymeric resins, such as polyvinyl chloride, polypropylene, polyethylene and the like. The sheet of heat shrinkable material 10 may vary in color and may include a design and/or decorative pattern 20 which can be printed, etched, and/or embossed on the sheet of heat shrinkable material 10 using inks or other printing materials. An example of an ink which may be applied to the surface of the sheet of heat shrinkable material 10 is described in U.S. Pat. No. 5,147,706 entitled "Water Based Ink On Foil And/Or Synthetic Organic Polymer", issued to Kingman on Sep. 15, 1992, which is hereby expressly incorporated herein by reference.

The thickness of the sheet of heat shrinkable material 10 utilized herein can vary widely as long as the sheet of heat shrinkable material 10 functions in accordance with the present invention as described herein. Generally, however, the sheet of heat shrinkable material will have a thickness in a range of from about 0.1 mil to about 30 mils.

Preferably, the sheet of heat shrinkable material 10 is flexible, however, again, it should be understood that the sheet of heat shrinkable material 10 may be constructed from any material as long as the sheet of heat shrinkable material 10 functions in accordance with the present invention as described herein.

Although the sheet of heat shrinkable material 10 shown in the FIG. 1 is a single layer of heat shrinkable material, the sheet heat shrinkable material 10 may be constructed of a plurality of layers of the same or different types of heat shrinkable materials. The layers of heat shrinkable material comprising the sheet of heat shrinkable material 10 may be connected together or laminated or may be separate layers. The sheet of heat shrinkable material 10 may be composed entirely of heat shrinkable material, or portions of the sheet of heat shrinkable material 10 may be a non-heat shrinkable material.

In addition, the sheet of heat shrinkable material 10 may have various colorings, coatings, flocking and/or metallic finishes, or other decorative surface ornamentation applied separately or simultaneously or may be characterized totally or partially by pearlescent, translucent, transparent, iridescent, neon, or the like, qualities. Each of the above-named characteristics may occur alone or in combination and may be applied to the upper and/or lower surface of the material comprising the sheet of heat shrinkable material 10. Moreover, portions of the heat shrinkable material used in constructing the sheet of heat shrinkable material 10 may vary in the combination of such characteristics. The sheet of heat shrinkable material 10 may be opaque, translucent, transparent, or partially clear or tinted transparent.

Referring now to FIG. 2 and 3, shown therein is the floral assembly 12 constructed in accordance with the present invention. The floral assembly 12 includes a flower pot 22, a floral grouping 24 and a decorative cover 26.

The term "flower pot" as used herein refers to any type of container used for holding a floral grouping. Examples of pots, used in accordance with the present invention include, but not by way of limitation, clay pots, wooden pots, plastic pots, ceramic pots, pots made from natural and/or synthetic fibers, or any combination thereof.

The flower pot 22 is provided with an open upper end 28, a rim 30 surrounding the open upper end 28, a substantially closed lower end 32, a sidewall 34, and an outer peripheral surface 36. The substantially closed lower end 32 and the sidewall 34 of the flower pot 22 cooperate to define a retaining space 38 which is in open communication with the open upper end 28 of the flower pot 22.

The flower pot 22 is adapted to receive the floral grouping 24 or botanical item in the retaining space 38. The floral grouping 24 may be disposed within the flower pot 22 along with a suitable growing medium 40 described in further detail below, or floral holding material, such as a floral foam.

The term "floral grouping" as used herein means cut fresh flowers, artificial flowers, a single flower, other fresh and/or artificial plants or other floral materials and may include other secondary plants and/or ornamentation or artificial or natural materials which add to the aesthetics of the overall floral grouping. The term "floral grouping" also includes a growing potted plant having a root portion. It will be appreciated that the floral grouping may consist of only a single bloom, only foliage, a botanical item, or a propagule.

The term "growing medium" when used herein means any liquid, solid or gaseous material used for plant growth or for the cultivation of propagules, including organic and inorganic materials such as soil, humus, parallel vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

In order to provide the decorative cover 26 for the flower pot 22, the sheet of heat shrinkable material 10 (FIG. 1) is sized and dimensioned to be disposed about at least a portion of the outer peripheral surface 36 of the flower pot 22. Once the sheet of heat shrinkable material 10 is disposed about at least a portion of the outer peripheral surface 36 of the flower pot 22 the sheet of heat shrinkable material 10 is heated to shrink the sheet of heat shrinkable material 10 until it pressingly engages against at least a portion of the outer peripheral surface 36 of the flower pot 22 and thereby forms the decorative cover 26 which is secured to the flower pot 22.

Heating of the sheet of heat shrinkable material 10 can be accomplished manually, as with a hand-held heat gun, or with a automated heating process. Further, the decorative cover 26, or any other decorative covers or collars hereinafter described, can be formed about the flower pot 22 prior to shipment by the grower, after reaching the shipping destination or at the point of sale. If the decorative cover 26 or a decorative collar or a combination of the decorative cover 26 and a decorative collar is formed about the flower pot 22 at the point of sale, the customer may be able to select the decorative cover 26 or decorative collar from a plurality and variety of available decorative covers and decorative collars thereby providing the customer with a wide selection of colors, patterns and graphic effects.

The size and configuration of the sheet of heat shrinkable material 10 can vary widely and will be determined to a large extent by the desired configuration of the decorative cover 26 to be formed about the flower pot 22 and the size and configuration of the flower pot 22.

The shape of the sheet of heat shrinkable material 10 utilized to form the decorative cover 26 illustrated in FIGS. 2 and 3 is substantially circular in configuration. Further, the sheet of heat shrinkable material 10 is sized such that upon forming the sheet of heat shrinkable material 10 about the outer peripheral surface 36 of the flower pot 22 and applying a sufficient amount of heat to the sheet of heat shrinkable material 10, the sheet of heat shrinkable material 10 is caused to shrink and thereby form the decorative cover 26 which substantially conforms to the outer peripheral surface 36 of the flower pot 22 as shown in FIGS. 2 and 3.

Figure 4:
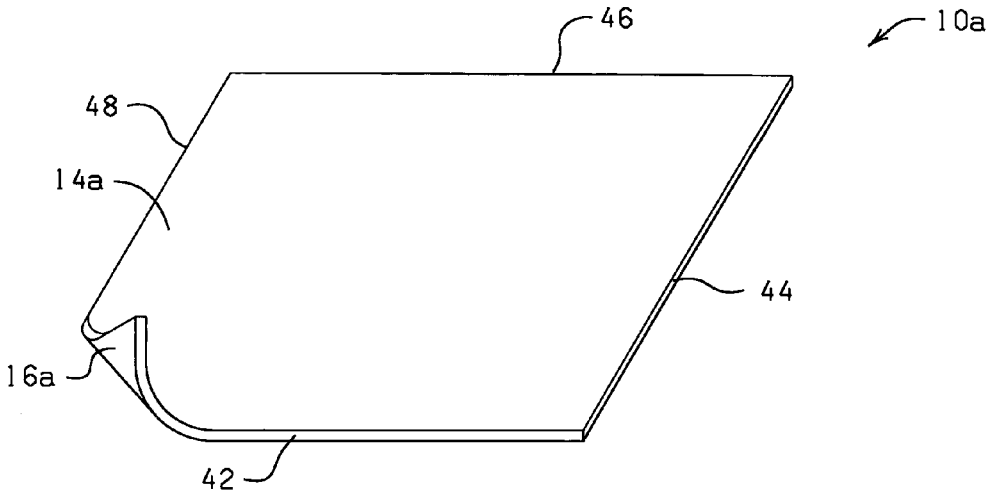
FIG. 4 is a perspective view of another embodiment of a sheet of heat shrinkable material utilized in forming a decorative cover in accordance with the present invention, one corner of the sheet of heat shrinkable material being upwardly turned.
Figure 5:
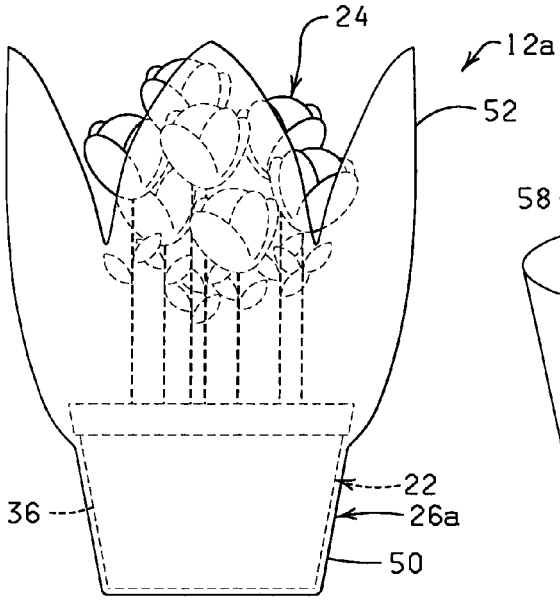
FIG. 5 is an elevational view of another embodiment of a floral assembly constructed in accordance with the present invention.

Referring now to FIG. 4, shown therein is a sheet of heat shrinkable material 10*a* utilized to form a decorative cover 26*a* about the flower pot 22 shown in FIG. 5. The sheet of heat shrinkable material 10*a* is similar to the sheet of heat shrinkable material 10 except the sheet of heat shrinkable material 10*a* is square in configuration. The sheet of heat shrinkable material 10*a* has an upper surface 14*a*, a lower surface 16*a*, first side 42, a second side 44, a third side 46 and a fourth side 48. In this embodiment, the sheet of heat shrinkable material 10*a* is sized so as to be substantially larger than the outer peripheral surface 36 of the flower pot 22.

Referring now to FIG. 5 shown therein is a floral assembly 12*a*. The floral assembly 12*a* includes the flower pot 22, the floral grouping 24 and the decorative cover 26*a*. The decorative cover 26*a* includes a base portion 50 and a skirt portion 52. The base portion 50 constitutes that portion of the decorative cover 26*a* disposed about the outer peripheral surface 36 of the flower pot 22; while the skirt portion 52 constitutes that portion of the decorative cover 26*a* which extends from an upper end of the base portion 50 and substantially surrounds the floral grouping 24. The decorative cover 26*a* is formed by disposing a portion of the sheet of heat shrinkable material 10*a* about the outer peripheral surface 36 of the flower pot 22 and applying heat to the portion of the sheet of heat shrinkable material 10*a* disposed about the flower pot 22 to shrink the portion of the sheet of heat shrinkable material 10*a* into an engagement against the outer peripheral surface 36 of the flower pot 22 and thereby provide the decorative cover 26*a* for the floral assembly 12*a*.

Figure 6:
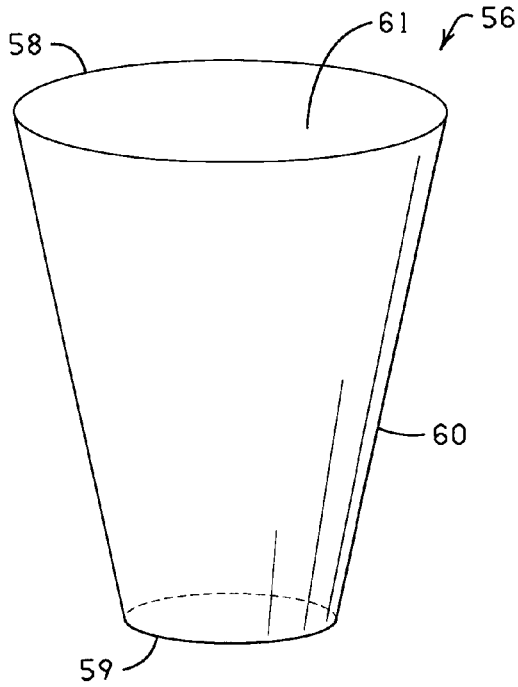
FIG. 6 is a perspective view of a sleeve formed from a heat shrinkable material in accordance with the present invention.

Shown in FIG. 6 and designated therein by the general reference numeral 56 is a sleeve of unitary construction. The sleeve 56, which is formed of a heat shrinkable material, is initially in a flattened state and is openable into an open state wherein the sleeve 56 is provided with a tubular configuration. The sleeve 56 has an open upper end 58, an open lower end 59, a sidewall 60 and a passageway 61 extending between the open upper end 58 and open lower end 59 of the sleeve 56. The sleeve 56 may also be equipped with drains or ventilation holes (not shown), or can be made from permeable or impermeable heat shrinkable materials. The sleeve 56 may be tapered outwardly from the open lower end 59 toward a larger diameter at its open upper end 58. In its flattened state the sleeve 56 has an overall trapezoidal or modified trapezoidal shape, and when opened is substantially frusto-conical to coniform. It will be appreciated, however that the sleeve 56 may comprise variations on the aforementioned shapes or may comprise significantly altered shapes such as square or rectangular, as long as the sleeve 56 functions in accordance with the present invention in the manner described herein.

The sleeve 56 is generally frusto-conically shaped, but the sleeve 56 may be, by way of example but not by way of limitation, cylindrical, frusto-conical, a combination of both frusto-conical and cylindrical, or any other shape, as long as the sleeve 56 functions as described herein as noted above. Further, the sleeve 56 may comprise any shape, whether geometric, non-geometric, asymmetrical and/or fanciful as long as it functions in accordance with the present invention. In addition, while the sleeve 56 has been shown and described as having the open lower end 59, it should be understood that the lower end of the sleeve 56 could be closed, and the closed lower end could contain one or more gussets.

Figure 7:
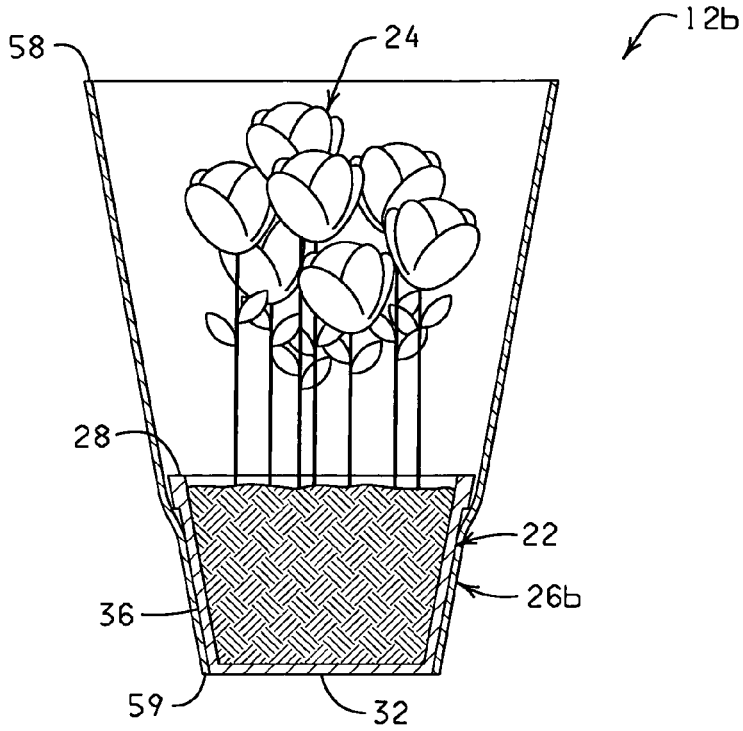
FIG. 7 is a cross-sectional view of a decorative cover for a flower pot formed from the sleeve of FIG. 6 in accordance with the present invention.

Referring now to FIG. 7, shown therein is a floral assembly 12*b* constructed in accordance with the present invention. The floral assembly 12*b* includes the flower pot 22, the floral grouping 24,and the decorative cover 26*b*.

The decorative cover 26*b* is formed about the flower pot 22 by inserting the flower pot 22 into the passageway 61 of the sleeve 56 (FIG. 6), such that at least a portion of the sleeve 56 is disposed about the outer peripheral surface 36 of the flower pot 22. Thus, upon heating the portion of the sleeve 56 disposed about the outer peripheral surface 36 of the flower pot 22, at least a portion of the sleeve 56 is shrunk such that at least a portion of the sleeve 56 engages the outer peripheral surface 36 of the flower pot 22 and thereby provides the decorative cover 26*b*.

Although the lower end 59 of the sleeve 56 is shown in FIG. 7 as terminating near the substantially closed lower end 32 of the flower pot 22 and the open upper end 58 of the sleeve 56 is shown as extending upwardly about the floral grouping 24, it will be understood that the open upper end 58 of the sleeve 56 can be disposed substantially adjacent the open upper end 28 of the flower pot 22 so that the decorative cover 26*b* extends about the outer peripheral surface 36 of the flower pot 22.

Figure 8:
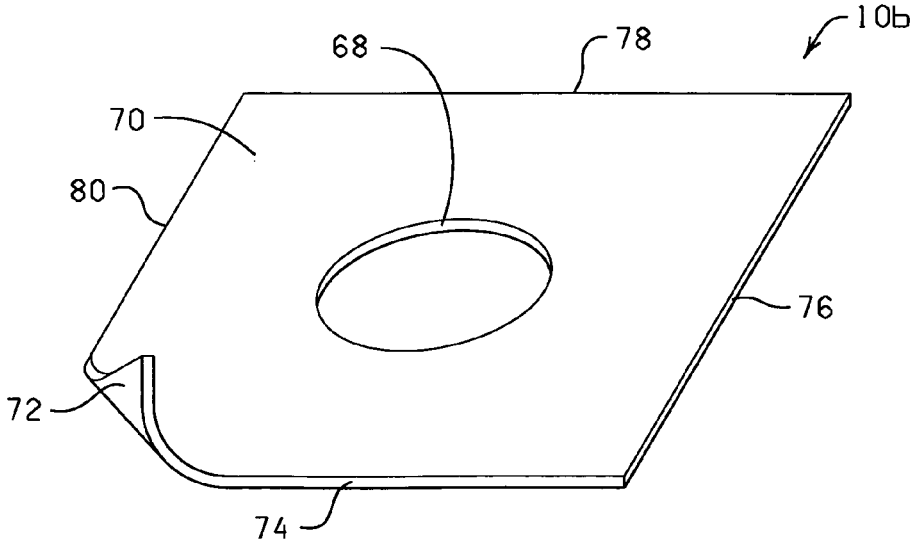
FIG. 8 is a perspective view of another embodiment of a sheet of heat shrinkable material utilized in forming a decorative collar about a flower pot in accordance with the present invention, one edge of the sheet of material being upwardly turned.
Figure 9:
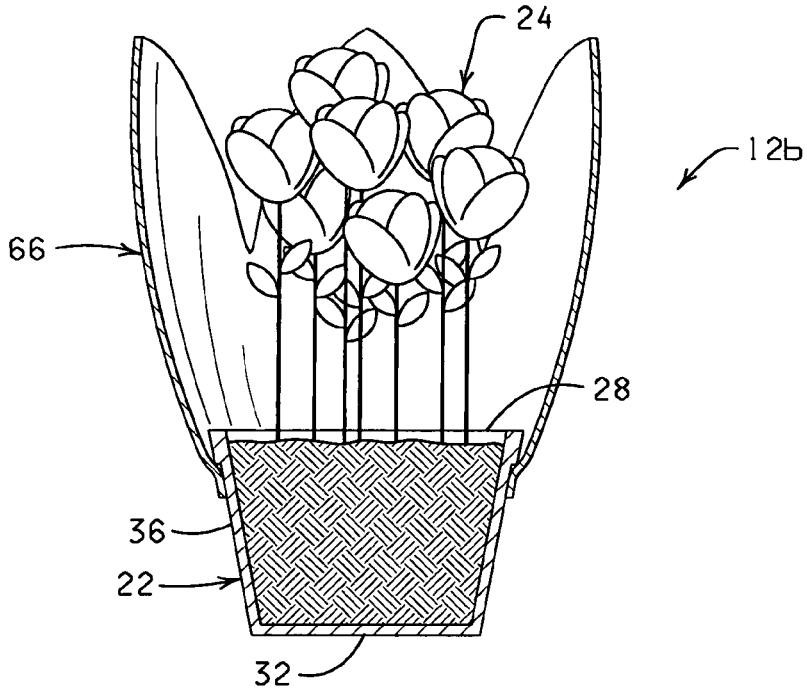
FIG. 9 is a cross-sectional view of another embodiment of a floral assembly constructed in accordance with the present invention.

Referring now to FIG. 8 shown therein is a sheet of heat shrinkable material 10*b* which can be used to form a decorative collar 66 shown in FIG. 9. The sheet of heat shrinkable material 10*b* is similar to the sheet of heat shrinkable material 10*a* except the sheet of heat shrinkable material 10*b* has an opening 68 formed there through. The sheet of heat shrinkable material 10*b* includes an upper surface 70, a lower surface 72, a first side 74, a second side 76, a third side 78, a fourth side 80 and the opening 68. The opening 68 of the sheet of heat shrinkable material 10*b* provides an area through which the flower pot 22, or the flower pot 22 having the decorative cover 26 (FIGS. 2 and 3) can be disposed. Preferably, the opening 68 is formed through a central portion of the sheet of heat shrinkable material 10*b*, however, the opening 68 may be "off center". The opening 68 is preferably sized and shaped so as to approximate the shape and outer peripheral surface 36 of the flower pot 22 near the open upper end 28 of the flower pot 22. The sheet of heat shrinkable material 10*b* can be of virtually any desired geometric configuration such as by way of example square, rectangular, circular, oval, octagonal, decorative or fanciful. The size of the sheet of heat shrinkable material 10*b* used to form the decorative collar 66 can be of any desired size as long as the sheet of heat shrinkable material 10*b* can function for its intended purpose. The sheet of heat shrinkable material 10*b* can have printed or embossed design or material on either the upper surface 70, the lower surface 72, or both the upper surface 70 and the lower surface 72.

Referring now to FIG. 9 shown therein is a floral assembly 12*b*. The floral assembly 12*b* includes the flower pot 22, the floral grouping 24 and the decorative collar 66. The decorative collar 66 is formed about a portion of the outer peripheral surface 36 of the flower pot 22 near the open upper end 28 thereof by disposing the closed lower end 32 of the flower pot 22 above the opening 68 in the sheet of heat shrinkable material 10*b* and moving the flower pot 22 into the opening 68 in the sheet of heat shrinkable material 10*b*. A portion of the sheet of heat shrinkable material 10*b* surrounding the opening 68 in the sheet of heat shrinkable material 10*b* is thereby placed in close proximity to, or adjacent the outer peripheral surface 36 of the flower pot 22 generally near the open upper end 28 of the flower pot 22. The portion of the sheet of heat shrinkable material 10*b* near the opening 68 may engage the outer peripheral surface 36 of the flower pot 22 during the mere action of pulling or pushing the flower pot 22 through the opening 68, or the portion of the sheet of heat shrinkable material 10*b* near the opening 68 may be manually or automatically pressed against the outer peripheral surface 36 of the flower pot 22. Thereafter, the portion of the sheet of heat shrinkable material 10*b*, in close proximity to or adjacent the outer peripheral surface 36 of the flower pot 22, is heated to secure the sheet of heat shrinkable material 10*b* to the flower pot 22 and thereby provide the decorative collar 66 for the floral assembly 12*b*. The decorative collar 66 extends upwardly and outwardly from the open upper end 28 of the flower pot 22.

Figure 10:
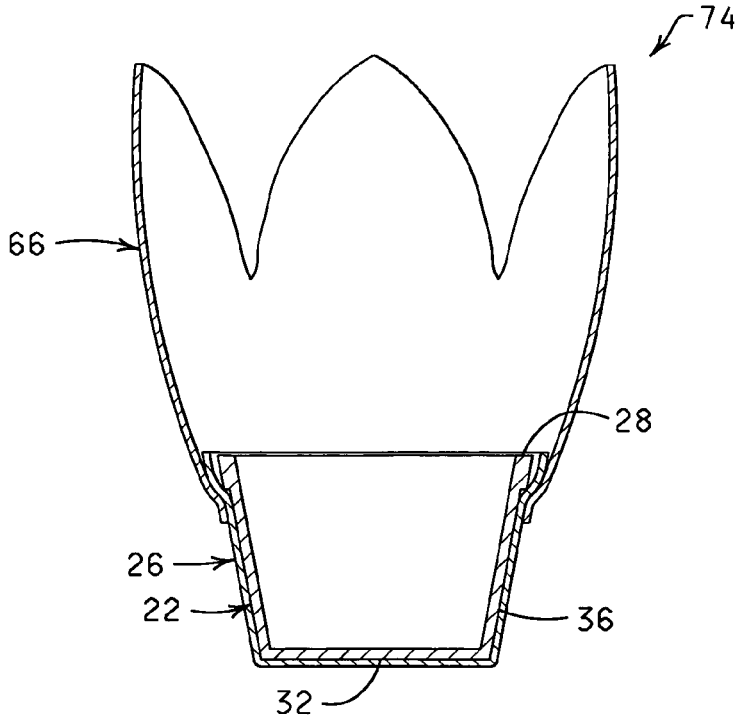
FIG. 10 is a cross-sectional view of a decorative cover/decorative collar combination constructed in accordance with the present invention.

Referring now to FIG. 10 shown therein is a decorative cover/decorative collar combination 82. The decorative cover/decorative collar combination 82 includes the flower pot 22, the decorative cover 26 and the decorative collar 66. The sheet of heat shrinkable material 10 (FIG. 1), also referred to herein as a first sheet of heat shrinkable material, is formed into the decorative cover 26 about the flower pot 22, as previously described, and the sheet of heat shrinkable material 10*b* (FIG. 8), also referred to herein as a second sheet of heat shrinkable material, is formed into the decorative collar 66 and positioned about a portion of the decorative cover 26.

More specifically, the closed lower end 32 of the flower pot 22 is disposed over the sheet of heat shrinkable material 10, the sheet of heat shrinkable material 10 being in a substantially planar condition. The sheet of heat shrinkable material 10 is then formed around the outer peripheral surface 36 of the flower pot 22 such that at least a portion of the sheet of heat shrinkable material 10 is substantially adjacent and substantially encompasses the outer peripheral surface 36 of the flower pot 22. At least a portion of the sheet of heat shrinkable material 10 substantially adjacent the outer peripheral surface 36 of the flower pot 22 is heated until such portion of the sheet of heat shrinkable material 10 shrinks to substantially conform to and substantially adhere to at least a portion of the outer peripheral surface 36 of the flower pot 22 thereby forming the decorative cover 26.

The closed lower end 32 of the flower pot 22 having the decorative cover 26 formed thereabout as previously described, is disposed over the opening 68 in the sheet of heat shrinkable material 10*b*, the sheet of heat shrinkable material 10*b*, being in a substantially planar condition. The flower pot 22 having the decorative cover 26 formed thereabout is moved into the opening 68 in the sheet of heat shrinkable material 10*b*. A portion of the upper surface 70 of the sheet of heat shrinkable material 10*b* near the opening 68 engages the decorative cover 26 formed about the outer peripheral surface 36 of the flower pot 22. The portion of the sheet of heat shrinkable material 10*b* near the opening 68 may engage the decorative cover 26 surrounding the outer peripheral surface 36 of the flower pot 22 during the mere action of pulling or pushing the flower pot 22 and decorative cover 26 through the opening 68, or the portion of the sheet of heat shrinkable material 10*b* near the opening 68 may be manually or automatically pressed against the decorative cover 26 to form the portion of the sheet of heat shrinkable material 10*b* near the opening 68 into close proximity with the decorative cover 26. Thereafter, the portion of the sheet of heat shrinkable material 10*b* engaged against or in close proximity to the decorative cover 26 surrounding the outer peripheral surface 36 of the flower pot 22, is heated to further secure the decorative cover 26 and the decorative collar 66 about the flower pot 22 thereby providing the decorative cover/decorative collar combination 82. The decorative collar 66 desirably extends upwardly and outwardly from the open upper end 28 of the flower pot 22.

Although the decorative cover/decorative collar combination 82 is shown and described herein as being constructed by forming the decorative collar 66 over the decorative cover 26, those skilled in the art will readily understand and recognize that the decorative cover/decorative collar combination 82 could be constructed by forming the decorative collar 66 about the flower pot 22 and then forming the decorative cover 26 about the flower pot 22,and a lower portion of the decorative collar 66. Furthermore, multiple layers of sleeves 56, decorative collars 66 and decorative covers 26 can be formed about the flower pot 22.

It is to be understood that even though numerous characteristics and advantages of various embodiments of the present invention have been set forth in the foregoing description, together with details of the structure and function of various embodiments of the invention, this disclosure is illustrative only, and changes may be made in details especially in matters of structure and arrangement of parts within the principles of the present invention to the full extent indicated by the broad general meaning of the terms in which the appended claims are expressed.

What is claimed is:

1. A method for providing a decorative cover collar combination for a flower pot comprising the steps of:

providing a flower pot with an open upper end, a closed lower end and an outer peripheral surface and retaining space;

provide a first sheet of heat shrinkable material;

forming the first sheet of heat shrinkable material about at least a portion of the outer peripheral surface of a flower pot;

heating the first sheet of heat shrinkable material whereby the first sheet of heat shrinkable material pressingly engages against at least a portion of the outer peripheral surface of the flower pot to form a decorative cover for the flower pot;

providing a second sheet of heat shrinkable material having an opening provided therein, the opening sized and shaped to approximate the shape and perimeter of the flower pot near the open upper and thereof;

disposing the flower pot having the decorative cover formed thereabout through the opening in the second sheet of heat shrinkable material and forming a portion of the second sheet of heat shrinkable material near the opening about at least a portion of the outer peripheral surface of the flower pot; and heating the second sheet of heat shrinkable material whereby the second sheet of heat shrinkable material pressingly engages against at least a portion of the outer peripheral surface of the flower pot to provide the decorative cover collar combination for the flower pot.

2. The method of claim 1 wherein, in the step of forming a first sheet of heat shrinkable material, the first sheet of heat shrinkable material is provided with a printed pattern disposed thereon.

3. The method of claim 1 wherein, in the step of forming the second sheet of heat shrinkable material, the second sheet of material is provided with a printed pattern disposed thereon.

4. The method of claim 1 wherein, in the step of forming the first sheet of heat shrinkable material, the first sheet of material is provided with a printed pattern disposed thereon.

* * * * *